US007142164B2

(12) United States Patent
Legay et al.

(10) Patent No.: US 7,142,164 B2
(45) Date of Patent: Nov. 28, 2006

(54) LOW-LOSS RECONFIGURABLE REFLECTOR ARRAY ANTENNA

(75) Inventors: Hervé Legay, Plaisance du Touch (FR); Béatrice Salome, Lanta (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/946,033

(22) Filed: Sep. 22, 2004

(65) Prior Publication Data

US 2005/0122273 A1 Jun. 9, 2005

(30) Foreign Application Priority Data

Sep. 23, 2003 (FR) ..... 03 11109

(51) Int. Cl.
*H01Q 3/22* (2006.01)

(52) U.S. Cl. ..... 343/754; 343/854; 343/853; 343/855; 342/370

(58) Field of Classification Search ..... 343/754
See application file for complete search history.

(56) References Cited

U.S. PATENT DOCUMENTS

| | | | | |
|---|---|---|---|---|
| 3,965,475 | A * | 6/1976 | Deerkoski et al. | 342/374 |
| 4,819,227 | A * | 4/1989 | Rosen | 370/325 |
| 5,936,588 | A * | 8/1999 | Rao et al. | 343/754 |
| 6,384,787 | B1 | 5/2002 | Kim | |
| 6,611,231 | B1 * | 8/2003 | Crilly et al. | 342/378 |
| 6,970,682 | B1 * | 11/2005 | Crilly et al. | 455/78 |
| 2002/0167449 | A1 | 11/2002 | Frazita et al. | |

FOREIGN PATENT DOCUMENTS

WO WO 02/23672 A 3/2002

OTHER PUBLICATIONS

M. Bialkowski et al, "Design, Development, and Testing of X-Band Amplifying Reflectarrays", IEEE Transactions on Antennas and Propagation, IEEE, Inc., New York, US, vol. 50, No. 8, Aug. 2002, pp. 1065-1076, XP001129675.

M. Bialkowski et al, "Spatial Power Combiner Using an Active Reflect-Array", 30th European Microwave Conference Proceedings. Paris, Oct. 3-5, 2000, Proceedings of the European Microwave Conference, London, vol. 1 of 3 Conf. 30, Oct. 3, 2000, pp. 28-283, XP001060748.

L. J. Sikora, Institute of Electrical and Electronics Engineers: "Flaps™ Reflector Antennas Features Well Suited for Commercial and Dual-Use Applications", Commerical Applications and Dual Use Technology, Atlanta, Jun. 16-17, 1993, Proceedings of the National Telesystems Conference, NY, IEEE, US, Jun. 16, 1993, pp. 233-238, XP000416097.

* cited by examiner

*Primary Examiner*—Don Wong
*Assistant Examiner*—Binh Van Ho
(74) *Attorney, Agent, or Firm*—Sughrue Mion, PLLC

(57) ABSTRACT

A reflector array antenna is divided into independent subarrays each comprising at least two radiating elements adapted firstly to collect signals delivered by a source and having at least one chosen first polarization and secondly to send phase-shifted signals having at least one chosen second polarization orthogonal to the first polarization. Each subarray sums the collected signals as a function of a chosen first phase law so that they correspond to a chosen source pointing direction, applies a chosen phase shift to the summed signals, and distributes the phase-shifted signals between the radiating elements as a function of a chosen second phase law so that the radiating elements of each subarray radiate them in a pointing direction of a chosen area. The combining and distribution are effected separately and the subarrays are therefore of a nonreciprocal type.

19 Claims, 7 Drawing Sheets

FIG.11
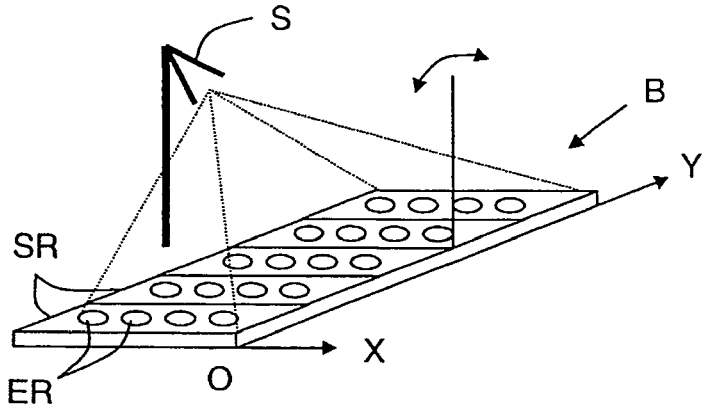
FIG.12
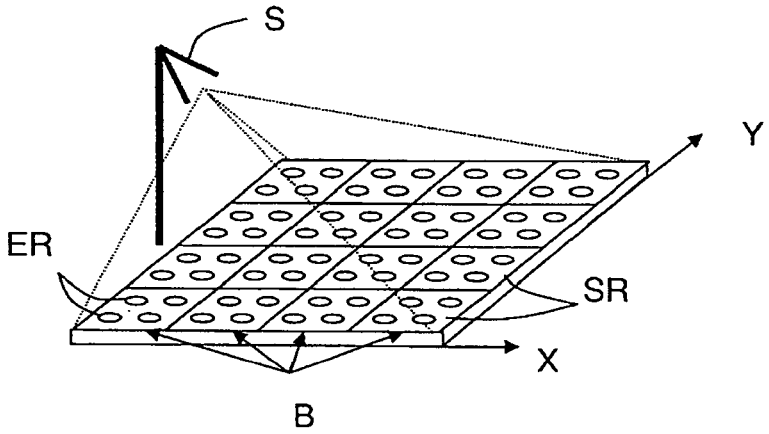
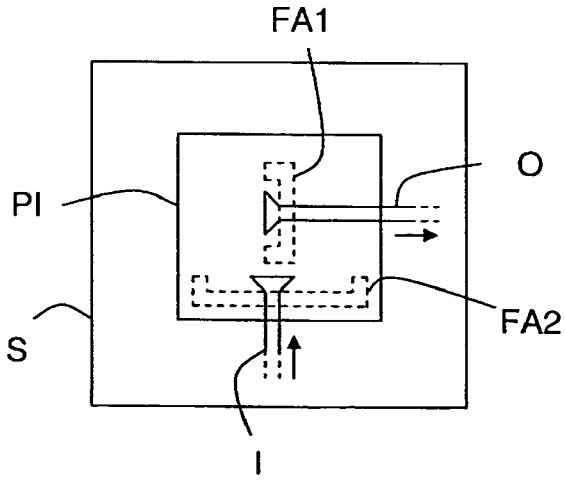
FIG.13

LOW-LOSS RECONFIGURABLE REFLECTOR ARRAY ANTENNA

CROSS-REFERENCE TO RELATED APPLICATIONS

This application is based on French Patent Application No. 03 11 109 filed Sep. 23, 2003, the disclosure of which is hereby incorporated by reference thereto in its entirety, and the priority of which is hereby claimed under 35 U.S.C. § 119.

BACKGROUND OF THE INVENTION

1. Field of the Invention

The field of the invention is that of array antennas and more particularly that of reflector array antennas.

2. Description of the Prior Art

There are two large families of array antennas, namely phased array antennas (PAA) and reflector array antennas (RAA).

Array antennas must be reconfigurable in order to move from one coverage area ("spot") to another.

In the case of phased array antennas, reconfigurability may be obtained by dividing the array into subarrays each associated with an active phase control device. The reconfigurability of the antenna then depends on only one constraint, namely the dimensions of each subarray, which depend on the dimensions of the coverage area to which the antenna must point.

In the case of reflector array antennas, it is essential that the radiating elements intercept with minimum losses the waves carrying the transmitted signals, which are delivered by a source. Now, the angle of incidence at which the radiating elements receive the waves varies as a function of their positions relative to the source. For certain arrays it may vary from 0° to 50°. An angular variation of this magnitude makes it particularly difficult both to receive waves coming from the source with a high gain and to transmit (or send) received waves over the whole of the pointed to coverage area with a high gain.

Reflector array antennas therefore routinely employ relatively undirectional radiating elements, with a typical dimension from 0.6λ to 0.7λ, where λ represents the operating wavelength. Reconfiguring the antenna diagram of this kind of antenna therefore necessitates equipping each radiating element with a phase control device. However, this kind of solution may lead to prohibitive costs.

Thus an object of the invention is to improve on this situation in the case of reflector array antennas.

SUMMARY OF THE INVENTION

To this end it proposes a reflector array antenna divided into independent subarrays each comprising:

at least two radiating elements adapted firstly to collect signals delivered by a source and having at least one chosen first polarization and secondly to send phase-shifted signals having at least one chosen second polarization orthogonal to the first polarization, combination means adapted to sum the collected signals as a function of a chosen first phase law so that they correspond to a chosen source pointing direction, phase control means adapted to apply a chosen phase shift to the summed signals, and distribution means adapted to distribute the phase-shifted signals between the radiating elements as a function of a chosen second phase law so that the radiating elements of each subarray radiate them in a pointing direction of a chosen area, in which antenna the combination means and the distribution means are separate so that the subarrays are of a nonreciprocal type.

According to another feature of the invention, the phase control means and the distribution means of the antenna are configurable so that the pointing direction of the chosen area is variable.

Each subarray may have other features, and in particular, either separately or in combination:

the phase control means may be phase shifters that comprise at least two delay lines with different configurations and at least one switch, for example a microelectromechanical system, the combination means may comprise a transmission line having branches coupled to the radiating elements to collect in parallel the signals having the first polarization and conformed to define the first phase law, the combination means may comprise a transmission line comprising line portions connecting the radiating elements to each other to collect in series the signals having the first polarization and conformed to define the first phase law, the distribution means may comprise a transmission line having branches coupled to the radiating elements to distribute in parallel the phase-shifted signals and conformed to define the second phase law, the distribution means may comprise a transmission line consisting of line portions connecting the radiating elements to each other to distribute in series the phase-shifted signals and conformed to define the second phase law, each subarray may be planar, each subarray may be linear, its radiating elements being aligned in a chosen direction, the subarrays may be installed in parallel to constitute a strip of at least two subarrays, the antenna may comprise at least two parallel strips, the radiating elements may be adapted to collect signals having the chosen first and second polarizations and comprising first polarization selection means interleaved between the radiating elements and the combination means and second polarization selection means interleaved between the distribution means and second the radiating elements, the first and second polarization selection means being adapted to select one of the first and second polarizations on command so that the antenna is able to operate in two different polarization modes, the radiating elements may be adapted to collect signals having the chosen first and second polarizations and comprise polarization selection means adapted to select one of the first and second polarizations on command so that the antenna is able to operate in two different polarization modes, each transmission line may be implemented in a technology chosen from a group comprising a microstrip technology, a coplanar technology and a triplate technology, the radiating elements may be chosen from a group comprising multilayer structures with radiating patches, microstrip resonators, slots and dielectric resonators, the radiating elements may be coupled to the combination means and to the distribution means by direct contact, the radiating elements may be coupled electromagnetically to the combination means and to the distribution means, and each subarray may comprise amplifier means adapted to amplify the summed waves before they are sent and/or once they have been collected.

Other features and advantages of the invention will become apparent on reading the following detailed description and examining the appended drawings.

BRIEF DESCRIPTION OF THE DRAWINGS

FIG. 11 is a diagrammatic representation of one example of a strip of nonreciprocal linear subarrays.

FIG. 12 is a diagrammatic representation of one example of combined nonreciprocal planar subarray strips.

FIG. 13 is a diagrammatic representation of one embodiment of a radiating element comprising asymmetrical slots.

DETAILED DESCRIPTION OF THE PREFERRED EMBODIMENTS

The appended drawings constitute part of the description of the invention and may, if necessary, contribute to the definition of the invention.

Figure 1:
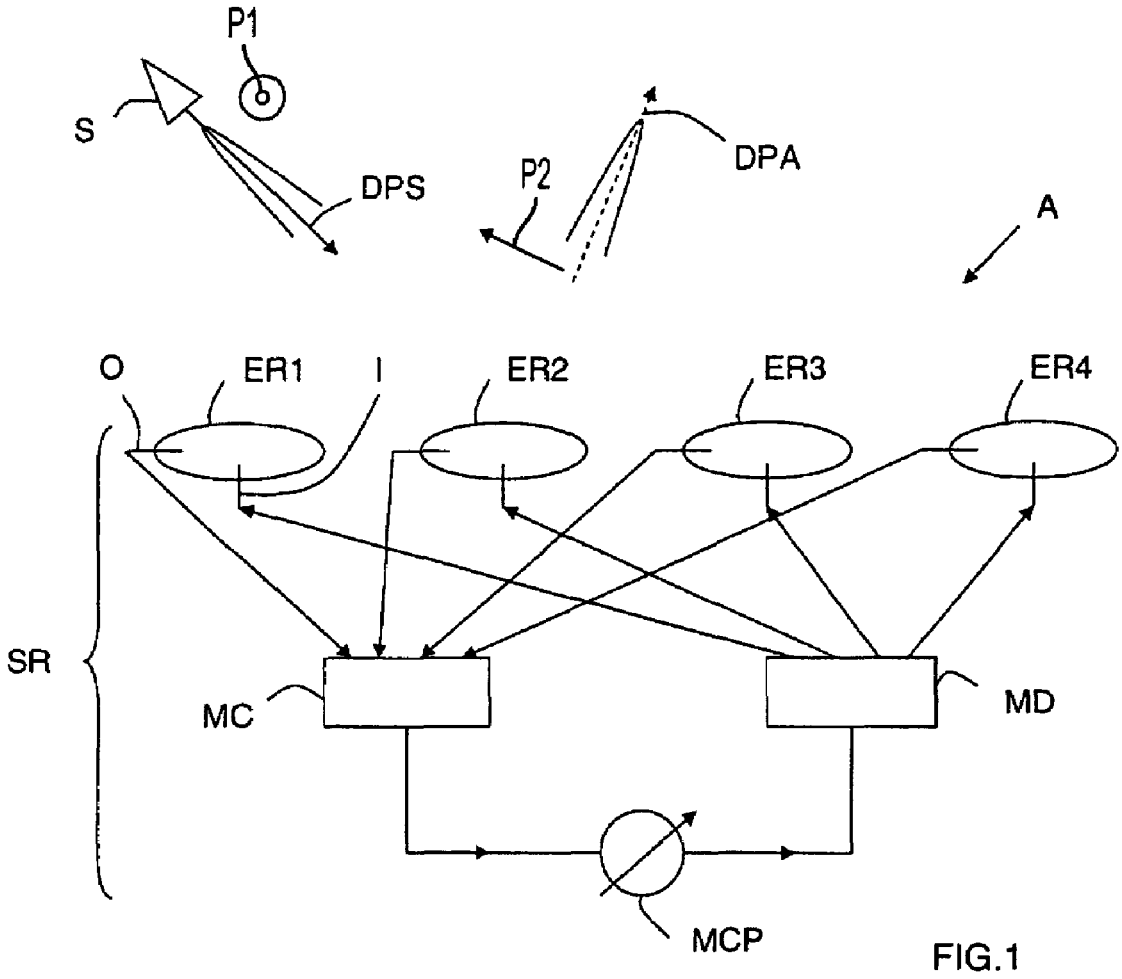
FIG. 1 is a block diagram of a subarray of a reflector array antenna according to the invention.

The invention is explained first with reference to FIG. 1.

A reflector array antenna A comprises first of all a source S delivering waves comprising signals to be transmitted into a chosen solid angle whose main direction is known as the source pointing direction (DPS). The antenna A also comprises a plurality of subarrays SR with a high gain for receiving waves delivered by the source S and transmitting them in a chosen solid angle whose main direction is known as the antenna pointing direction (DPA), in order to cover a chosen area with a high gain.

According to the invention, each of the subarrays SR, which are independent of each other, comprises, first of all, at least two radiating elements ERi (here i=1 to 4, but may take any other value greater than or equal to 2), firstly for collecting the signals delivered by the source S that reach them in the form of waves that have at least one chosen first polarization P1, and secondly for sending phase-shifted signals having at least one chosen second polarization P2 orthogonal to the first polarization. Each radiating element ERi delivers the signals that it has collected to an output O to which it is coupled.

Each subarray SR also comprises combination means fed with signals collected via the various outputs O and summing them as a function of a chosen first phase law in order for them to correspond to the chosen source pointing direction DPS.

Each subarray SR further comprises phase control means MCP fed with signals summed by the combination means MC and applying a chosen phase-shift to them.

Finally, each subarray SR comprises distribution means MD fed by the phase control means MCP with summed and phase-shifted signals and distributing them between the radiating elements ERi, via inputs I, as a function of a chosen second phase law so that the radiating elements radiate them in the antenna pointing direction DPA with the second polarization P2.

The subarrays SR are preferably of the nonreciprocal type. In a nonreciprocal subarray SR, the combination means MC and the distribution means MD are separate. They therefore constitute two separate feeder circuits.

Because of the two separate feeder circuits, it is possible to handle reception and transmission separately, and consequently to obtain a high gain for reception and a high gain for transmission (sending), provided that the pitch of the array is sufficiently small (typically 0.6λ to 0.7λ). The dimensions of the subarray SR are then chosen as a function of the maximum scanning angle necessary for transmission in the antenna pointing direction DPA, in the manner of an active phased array antenna.

A nonreciprocal subarray SR may be of planar or linear form.

Figure 2:
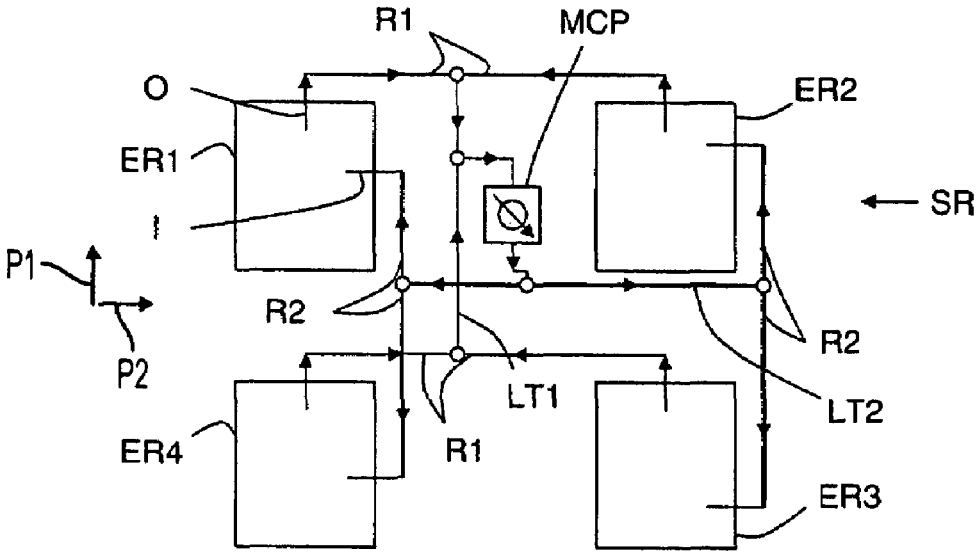
FIG. 2 is a diagrammatic representation of one embodiment of a nonreciprocal planar subarray.

Here the term "planar subarray" means a subarray SR of the type shown in FIG. 2. In this kind of subarray SR, the radiating elements ERi (here i=1 to 4) are disposed in a plane, for example at the four corners of a rectangular parallelepiped. In the example shown, each radiating element ERi delivers at its output O signals having a vertical first polarization P1 and is adapted to send summed signals having a horizontal second polarization P2.

Each output O constitutes the end of a branch R1 of a first transmission line LT1 connected to the input of the phase control means MCP and constituting the combination means MC. The configurations of the transmission line LT1 and its branches R1 are chosen to compensate the differences between the paths taken by the waves between the source S and the various radiating elements ERi in accordance with the first phase law associated with the source pointing direction DPS for the subarray SR concerned. This compensation constitutes what is referred to hereinabove as combining the signals.

Here, all the radiating elements ERi feed the combination means MC in parallel. However, a serial feed variant may be envisaged. In this case, the transmission line LT1 consists of portions of lines that connect the radiating elements ERi to each other.

Moreover, each input I constitutes the end of a branch R2 of a second transmission line LT2 connected to the output of the phase control means MCP and constituting the distribution means MD. The phase shift applied by the phase control means MCP and the configurations of the transmission line LT2 and its branches R2 are chosen in accordance with the second phase law associated with the antenna pointing direction DPA.

Here, distribution means MD feed the radiating elements ERi in parallel. However, a serial feed variant may be envisaged. In this case, the transmission line LT2 consists of portions of lines that connect the radiating elements ERi to each other.

It is important to note that, within an antenna A, the first phase law applied by the combination means MC may vary from one subarray to another because of their respective positions relative to the source S.

The transmission lines LT1 and LT2 and their branches R1 and R2 are preferably implemented in the microstrip technology. However, the transmission lines LT1 and LT2 and their branches R1 and R2 may instead be implemented in the triplate or coplanar technology.

Figure 3:
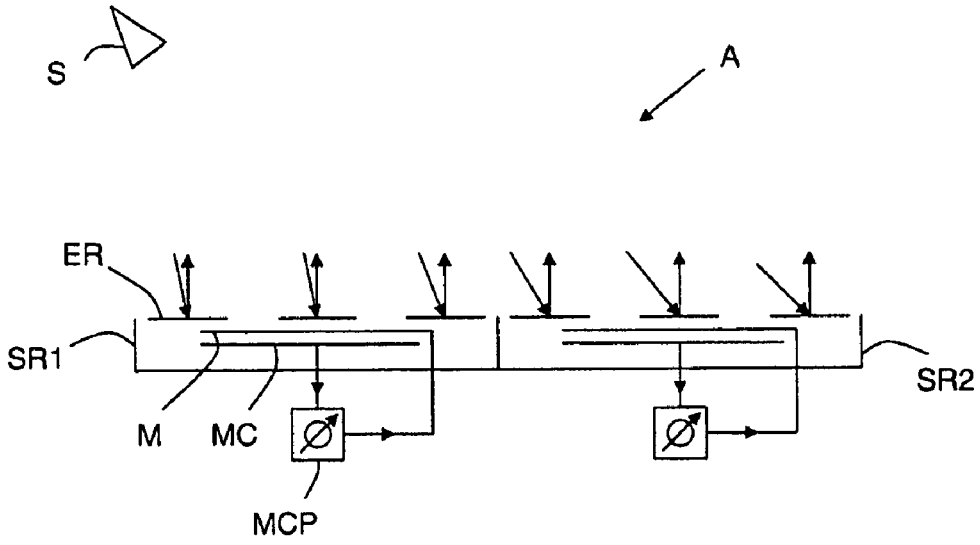
FIG. 3 is a view in cross section of a reflector array antenna according to the invention comprising two nonreciprocal planar subarrays.

Moreover, as seen most clearly in FIG. 3, because of the crossing over of the transmission lines LT1 and LT2, the combination means MC (LT1 and R1) and the distribution means MD (LT2 and R2) are preferably implemented at different levels of the structure of the subarray SR. In this example, the transmission lines are coupled directly (by contact) to the radiating elements ERi. However, a variant may be envisaged in which the coupling is effected by means of slots. In this case, the combination means MC and the distribution means MD may be installed at two different levels of the rear face.

Embodiments of nonreciprocal linear subarrays according to the invention are described next.

Figure 4:
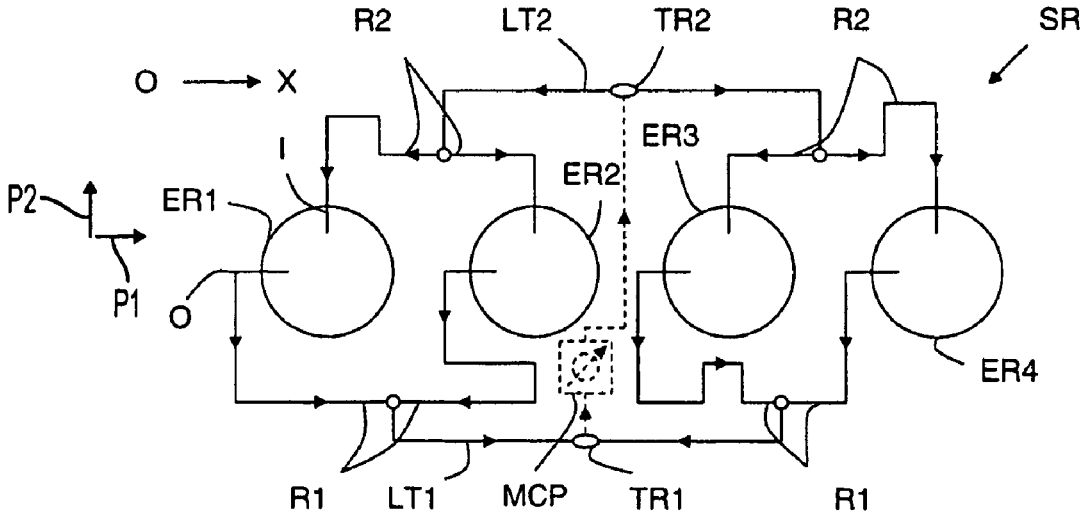
FIG. 4 is a diagrammatic representation of a first embodiment of a nonreciprocal linear subarray.

Here, the expression "linear subarray" means a subarray SR of the type shown in FIG. 4 or one of the variants thereof shown in FIGS. 5 to 10 and 15.

In a nonreciprocal subarray SR, the radiating elements ERi are disposed one after the other in a chosen direction OX. This disposition is particularly well suited, although not exclusively so, to synthetic aperture radar (SAR) antennas. Moreover, the combination means MC and the distribution means MD do not cross over, in contrast to planar subnetworks in which the combination means MC and the distribution means MD cross over because they are formed at two different levels.

In the FIG. 4 embodiment, each radiating element ERi (here i=1 to 4) delivers (at its output O) signals having the horizontal first polarization P1 and is adapted to send summed signals having a vertical second polarization P2. The radiating elements ERi of the subarray SR feed the combination means MC with signals of polarization P1 in parallel and the combination means combine them in accordance with the first phase law to feed the input of the phase control means MCP. The phase control means MCP feed summed and phase-shifted signals to the distribution means MD which are at the same level as the combination means MC and the distribution means MD, for example. Finally, the distribution means MD distribute the summed and phase-shifted signals to the radiating elements ERi in parallel and in accordance with the second phase law.

Because of the lack of space, the phase control means MCP are installed at a different level from the combination means MC and the distribution means MD. For this reason they are shown in dashed line.

In this embodiment, each output O of a radiating element ERi constitutes the end of a branch R1 of a first transmission line LT1 connected to the input of the phase control means MCP by a first transition TR1 and constituting the combination means MC. The configurations of the transmission line LT1 and its branches R1 are chosen to compensate the differences between the paths taken by the waves between the source S and the various radiating elements ERi in accordance with the first phase law associated with the source pointing direction DPS.

Each input I constitutes the end of a branch R2 of a second transmission line LT2 connected to the output of the phase control means MCP by a second transition TR2 and constituting the distribution means MD. To be more precise, the second transition TR2 is here connected to the output of the phase control means MCP by an auxiliary transmission line LT3.

The configurations of the auxiliary transmission line LT3 and the transmission line LT2 and its branches R2 are chosen in accordance with the second phase law associated with the antenna pointing direction DPA.

The transmission lines LT1 and LT2 and their branches R1 and R2 are also preferably implemented in the microstrip technology and on the same layer as the lower radiating patches of the radiating elements ERi. However, the transmission lines LT1 and LT2 and their branches R1 and R2 may instead be implemented in the triplate or coplanar technology.

Here, the patches of the radiating elements ERi are circular, but they could be square.

Figure 5:
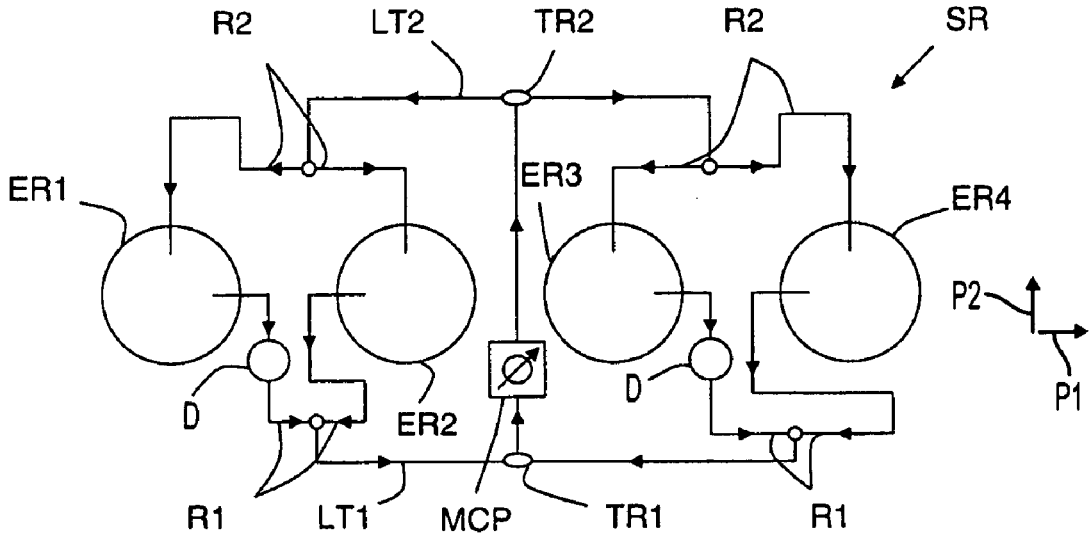
FIG. 5 is a diagrammatic representation of a second embodiment of a nonreciprocal linear subarray.

If it is possible to install the phase control means MCP at the same level as the combination means MC and the distribution means MD, the configuration shown in FIG. 5 may be used, for example.

This variant uses all the components of the FIG. 4 subarray but differs from the latter in that, firstly, the outputs O of the radiating elements ER1 and ER2 face each other, like those of the radiating elements ER3 and ER4, and, secondly, the phase control means MCP are at the same level as the combination means MC and the distribution means MD.

Because of this configuration, the signals delivered by the radiating elements ER1 and ER2 (respectively ER3 and ER4) at their respective outputs O have antiparallel polarizations here. A phase shifter D is therefore provided on the branch R1 that connects the radiating element ER1 (respectively ER3) to the transmission line LT1 for applying a phase shift of 180° to the signals that it receives before they are combined with the signals coming from the radiating element ER2 (respectively ER4).

Figures 6A, 6B:
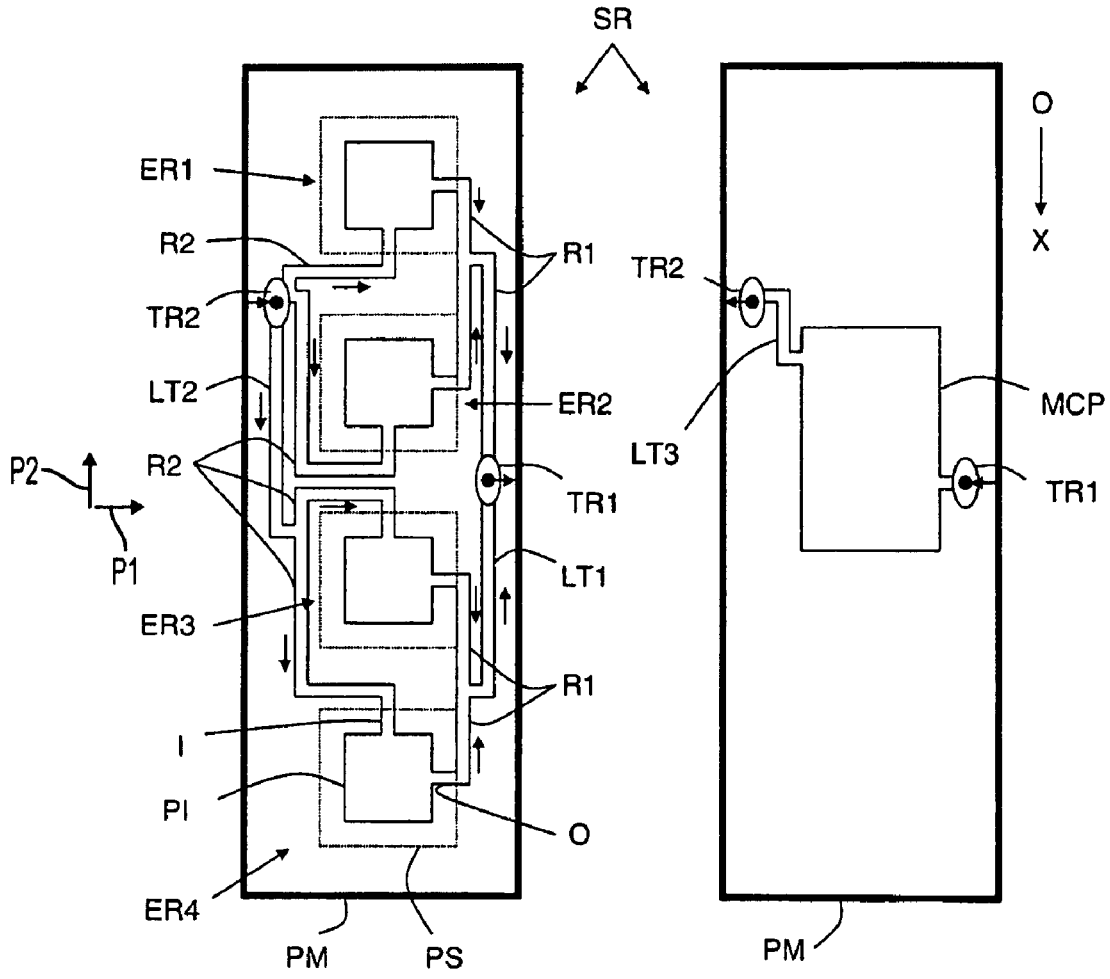
FIGS. 6A and 6B are diagrammatic representations of two portions of a third embodiment of a nonreciprocal linear subarray.

The embodiment shown in FIGS. 6A and 6B provides a better indication of the separation of the phase control means MCP, on the one hand, and the combination means MC and the distribution means MD, on the other hand, referred to above with reference to FIG. 4.

In this embodiment, the distribution means MD feed the radiating elements ERi in parallel with summed and phase-shifted signals to be sent with a vertical linear second polarization P2. It may be noted that here the inputs I of the radiating elements ERi and ER2 are placed "at the bottom" of the lower patches PI (with respect to the vertical direction of the page), whereas the inputs I of the radiating elements ER3 and ER4 are placed "at the top" of the lower patches PI (also with respect to the vertical direction of the page). Consequently, the polarization of the signals emitted by the radiating elements ER3 and ER4 is antiparallel to that of the signals emitted by the radiating elements ER1 and ER2. This therefore requires that the signals coming either from ER1 and ER2 or from ER3 and ER4 be phase shifted 180°, as shown in FIG. 5.

As shown in FIG. 6A, each radiating element ERi here consists in particular of a lower radiating patch PI that is on the layer comprising the combination means MC and the distribution means MD and an upper radiating patch PS (shown in dashed outline) that is above a dielectric layer in turn above the layer comprising the lower patches PI, the combination means MC, and the distribution means MD.

The phase control means MCP are implemented in a layer of the structure that is preferably to the rear of the ground plane (not shown) and the layer comprising the combination means MC and the distribution means MD (see FIG. 6B). Also, the multilayer structure is surrounded by metal walls PM.

In this embodiment, each output O of a radiating element ERi constitutes the end of a branch R1 of a first transmission line LT1 connected to the input of the phase control means MCP by a first transition TRI and constituting the combination means MC. The configurations of the transmission line LT1 and its branches R1 are chosen to compensate the differences between the paths taken by the waves between the source S and the various radiating elements ERi in accordance with the first phase law associated with the source pointing direction DPS.

Here, all the radiating elements ERi feed the combination means MC in parallel with signals having a horizontal first polarization P1.

Each input I constitutes the end of a branch R2 of a second transmission line LT2 connected to the output of the phase control means MCP by a second transition TR2 and constituting the distribution means MD. To be more precise, here the second transition TR2 is connected to the output of the phase control means MCP by an auxiliary transmission line LT3.

The configurations of the auxiliary transmission line LT3 and the transmission line LT2 and its branches R2 are chosen in accordance with the second phase law associated with the antenna pointing direction DPA.

The transmission lines LT1 and LT2 and their branches R1 and R2 are also preferably implemented in the microstrip technology and on the same layer as the lower patches PI. However, the transmission lines LT1 and LT2 and their branches R1 and R2 may instead be implemented in the triplate or coplanar technology.

In one embodiment, the combination means MC and the distribution means MD may be placed to the rear of the ground plane. In this case, each radiating element ERi is fed by two virtual transitions connected to its excitation points. This embodiment requires room to be freed up at the center for installing the phase control means MCP, which imposes an excitation configuration similar to that of FIG. 5 and thus the use of 180° phase shifters MM.

Another embodiment of a linear nonreciprocal subarray according to the invention is described next with reference to FIG. 7. This variant comprises most of the components of the FIG. 4 subarray, but differs from the latter in that, for reception, the radiating elements ERi are coupled to each other in series.

To be more precise, in this embodiment, the output O of the first radiating element ER1 feeds a first portion SP1 of the transmission line LT1 connected to the second radiating element ER2, whose output feeds a second portion SP2 of the transmission line LT1 connected to the third radiating element ER3, whose output feeds a third portion of the transmission line LT1, and here the output of the fourth radiating element ER4 feeds a fourth portion SP4 of the transmission line LT1, arranged differently from the other portions SP1 to SP3 in order to compensate the antiparallel excitation of the fourth radiating element ER4. The transmission line LT1 feeds the phase control means MCP, which feed the transmission line LT2 whose branches are connected to the inputs I of the radiating elements ERi.

This embodiment is particularly beneficial if it includes "reversible" phase control means MCP, as this enables the antenna A to operate in two polarization modes because, instead of feeding the transmission line LT1 serially with signals of horizontal polarization P1, the radiating elements ERi may feed the transmission line LT2 in parallel with summed and phase shifted signals to be sent with a vertical second polarization P2. In this case, the transmission line LT1 feeds the radiating elements ERi serially with signals of horizontal polarization P1.

Figure 8:
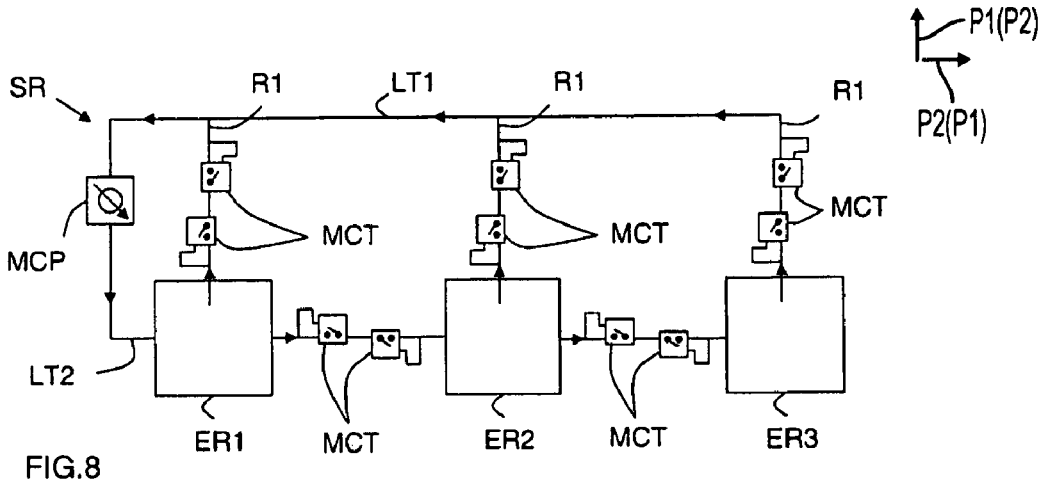
FIG. 8 is a diagrammatic representation of a fifth embodiment of a nonreciprocal linear subarray adapted for dual polarization.
Figure 9:
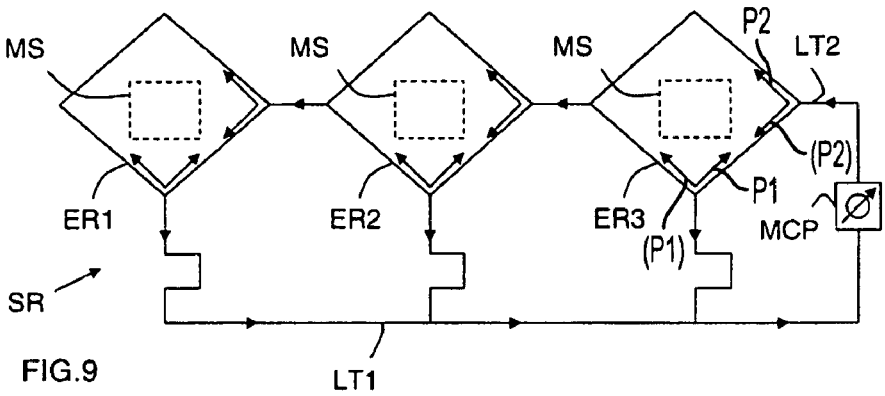
FIG. 9 is a diagrammatic representation of a sixth embodiment of a nonreciprocal linear subarray adapted for dual polarization.

FIGS. 8 and 9 show two variants of this embodiment. They enable the antenna A to operate in two different polarization modes.

Figure 7:
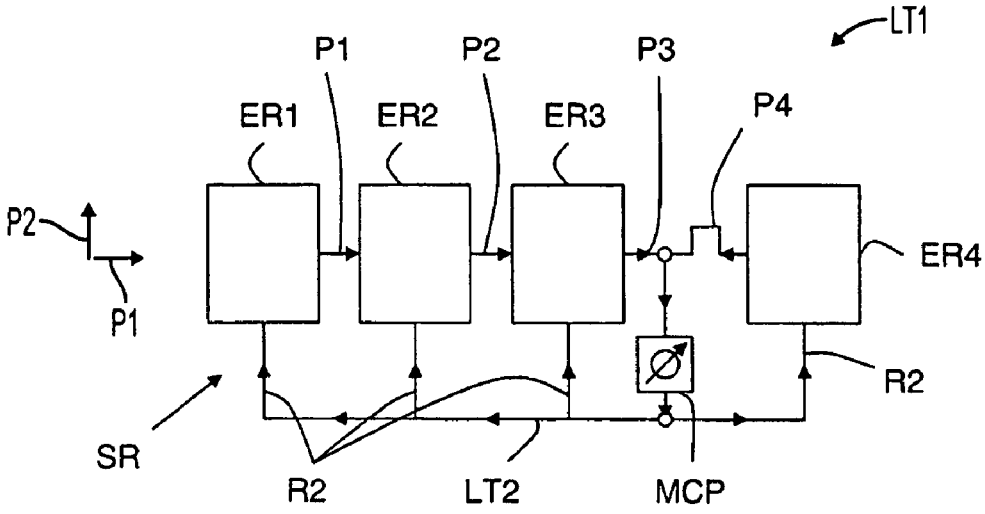
FIG. 7 is a diagrammatic representation of a fourth embodiment of a nonreciprocal linear subarray.

The first variant of the subarray SR, shown in FIG. 8, differs from the FIG. 7 subarray in that it uses switching modules MCT on the branches of the transmission line LT1 and on the transmission line LT2. To be more precise, in the configuration shown, the switching modules MCT (which are duplicated everywhere to allow operation in both directions) have a first setting for applying the phase law associated with the antenna pointing direction DPA. Signals having a vertical first polarization P1 are then collected in parallel, and summed and phase-shifted signals to be sent with a horizontal second polarization P2 are distributed serially. On the other hand, when all the switching modules MCT are in a second setting, the phase law associated with the source pointing direction DPS may be applied. This adapts the polarization to that of the source S. Signals having a horizontal first polarization are then collected serially, and summed and phase-shifted signals to be sent with a vertical second polarization are distributed in parallel.

As may be seen in FIG. 8, the two channels that connect the inputs (or outputs) of the switching modules MCT to the branches R1 or to the transmission line LT2 do not have the same configuration because they are associated with different phase laws.

The second variant of the subarray SR, shown in FIG. 9, differs from the FIG. 7 subarray in that the patches of the radiating elements ERi are no longer fed from their sides, but from their corners, so as to excite both polarizations simultaneously, and in that switching modules MS are used in the radiating elements ERi to select one of the two excited polarizations, both for collection and for sending.

Figure 10:
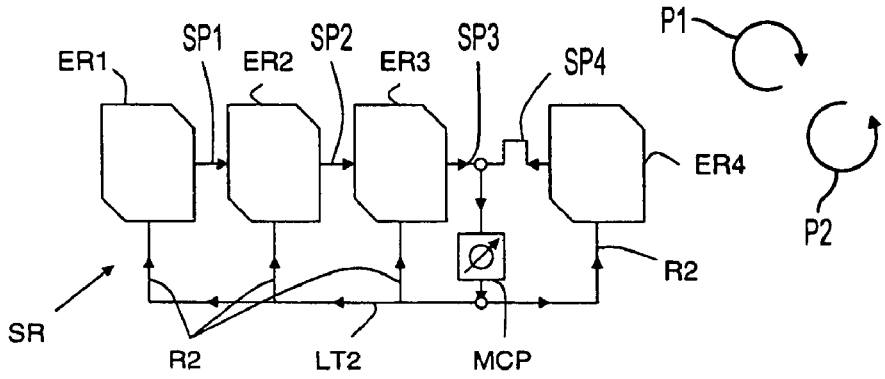
FIG. 10 is a diagrammatic representation of a seventh embodiment of a nonreciprocal linear subarray adapted for dual polarization.

It is important to note that the dual polarization is not necessarily linear. It may be circular. In this case, as shown in FIG. 10, the radiating elements ERi may be microstrip resonators truncated along their diagonal or slightly rectangular microstrip resonators, for example. In the FIG. 10 variant, the switches MCT enabling operation with dual polarization are not shown. However, in reality, they are placed at the input and at the output of the radiating elements ERi, as in the FIG. 8 embodiment.

Although this has not been mentioned as yet, making up strips of subarrays SR in a chosen direction enables the antenna pointing direction DPA to be varied, in other words renders the antenna reconfigurable.

A strip B of this kind, in the case of linear subarrays SR, is shown diagrammatically in FIG. 11. In this case, as shown in the figure, the subarrays SR of a strip B are placed one against the other parallel to their extension direction (here the direction OX). The antenna A is then reconfigurable in the direction OY (in elevation), i.e. in the plane perpendicular to the direction OX.

Also, as shown in FIG. 12, the antenna A may comprise a plurality of parallel strips B of planar subarrays in order for it to be reconfigurable both in the direction OY (in elevation), i.e. in the plane perpendicular to the direction OX, and in the direction OX, i.e. in the plane perpendicular to the direction OY.

As mentioned hereinabove, the radiating elements ERi preferably take the form of a conventional multilayer structure comprising, in particular, a lower radiating conductive patch PI coupled, firstly, to the input I and/or to the output O, and, secondly, to an upper radiating conductive patch PS for collecting waves coming from the source S and sending the collected waves after they have been converted. The coupling between the upper radiating patches PS and the lower radiating patches PI of a radiating element ERi may be effected either directly by conduction, by means of a conductive layer or vias, or electromagnetically, by means of a layer of dielectric material.

Figure 14:
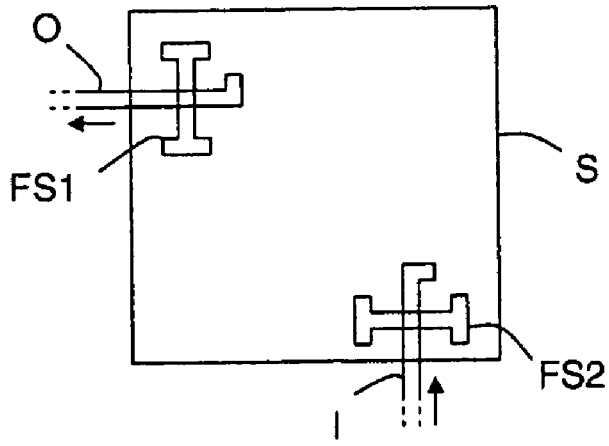
FIG. 14 is a diagrammatic representation of one embodiment of a radiating element comprising symmetrical slots.

It is important to note that if the subarray SR is to be able to operate with two polarizations (dual mode), its radiating elements ERi must be adapted accordingly. For example, two asymmetrical slots FA1 and FA2, as shown in FIG. 13, or two symmetrical slots FS1 and FS2, as shown in FIG. 14, may be integrated into the multilayer structure of the radiating elements ERi. These slots may be formed in the ground plane of the structure. The combination means MC are then installed on the rear face of the ground plane and coupled to the radiating patches via the slots.

Further information on the structure of the radiating elements and the slots may be found in the following documents in particular:

"Dual-polarized wideband microstrip antenna", S. C. GAO et al, Electronics Letters, 30 Aug. 2001, Vol. 37, N° 18, "Aperture coupled patch antennas with wide-bandwidth and dual polarization capabilities", C. M. TAO et al, Antennas and Propagation Society International Symposium, 1988, AP-S, Digest, June 1988, Vol. 3, pages 936–939, "Dual-polarized array for signal-processing applications in wireless communications", B. LINDMARK et al, IEEE Transactions on Antennas and Propagation, Vol. 46, Issue: 6 Jun. 1998, pages 758–763, "Wideband dual-polarized microstrip patch antenna", S. C. GAO et al, Electronics Letters, 27 Sep. 2001, Vol.37, N° 20, "Investigations into a power-combining structure using a reflect array of dual feed aperture-coupled microstrip patch antennas", Marek E. Bialkowsksi, IEEE Transactions on Antennas and Propagation, Vol. 50, Issue: 6 Jun. 2002, pages 841–849.

The use of symmetrical slots FS is preferred because it achieves better isolation between the two polarizations and does not generate high levels of crossed polarization.

For example, in the case of an SAR type application in the X band at 9.8 GHz, the substrate S, which carries the feeder circuits and the lower radiating patches PI, may be made from a PTFE type material having a dielectric constant of approximately 3.2, a loss tangent of approximately 0.003 at 10 GHz, a thickness of approximately 0.79 mm, and a copper thickness of approximately 17 μm. The separators placed between the radiating patches and the slots FA or FS may be made from a Rohacell 31 type material, for example, having a dielectric constant of approximately 1.05, a loss tangent of approximately 0.0002 at 2.5 GHz, and a thickness of approximately 2 mm. In this case, the pitch of the array (i.e. the distance between the radiating elements ERi) is made substantially equal to 20 mm, which corresponds to 0.65λ when the frequency is equal to 9.8 GHz.

The phase control means MCP of each subarray SRi preferably take the form of phase shifters and more preferably the form of delay lines with different configurations (so as to apply different phase shifts), coupled to at least one microelectromechanical (MEM) system providing the switching function. These systems are particularly advantageous because they have very low insertion losses, typically of the order of 0.1 dB for frequencies as high as 40 GHz.

The state of the MEM system is controlled by applying electrical voltages.

Figure 15:
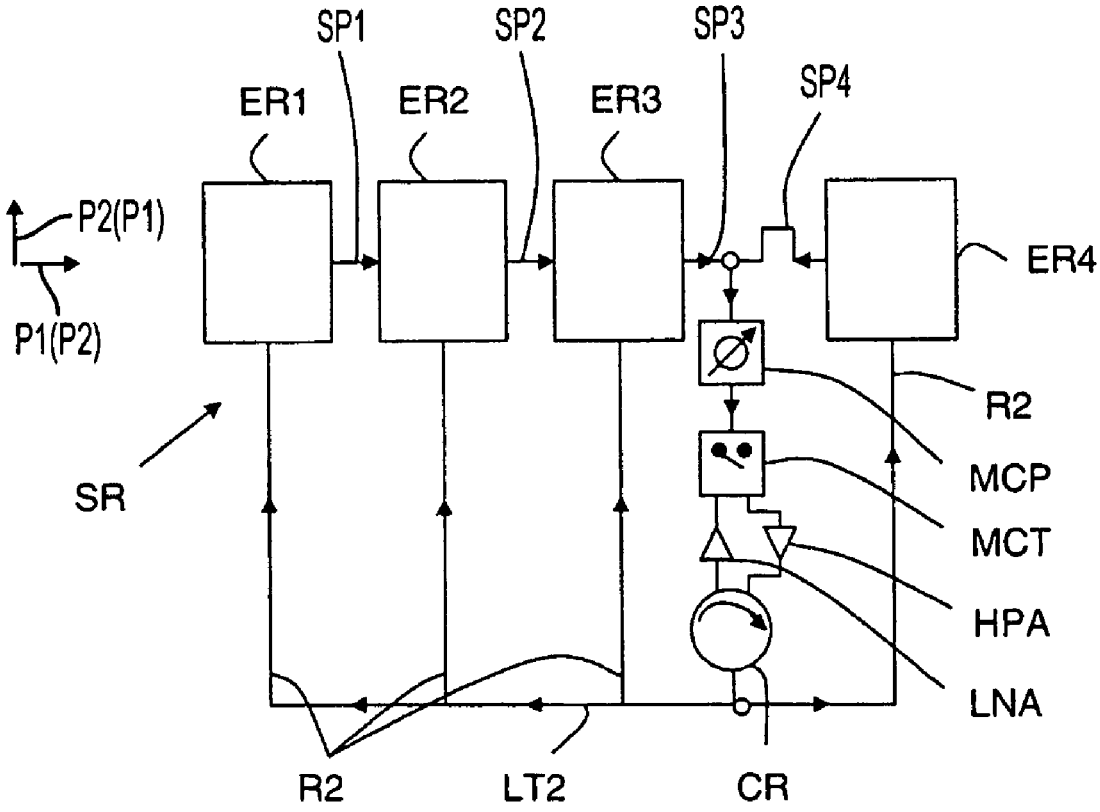
FIG. 15 is a variant of FIG. 7 showing signal amplification means.

As shown in FIG. 15, each subarray SR may further comprise low-noise amplifier (LNA) means and/or high-power amplifier (HPA) means for providing quasi-optical amplification of the summed waves before or after phase shifting by the phase control means MCP.

In the embodiment shown, the subarray SR comprises a circulator CR connected firstly to the transmission line LT2 and secondly to the amplifier means LNA and HPA, which are also connected to a switch MCT, which is itself connected to the phase control means MCP.

Thus, according to the states of the circulator CR and the switch MCT, the signals arrive either at the LNA to be amplified therein before "ascending" to the phase control means MCP and then the radiating elements ERi (enabling operation of the antenna in receive mode), or to the HPA to be amplified therein before "descending" to the radiating elements ERi (enabling operation of the antenna in transmit mode).

The amplifier means LNA and HPA may take the form of amplifier microchips, for example MMICs.

The invention is not limited to the embodiments of antennas described hereinabove by way of example only, but encompasses all variants that the person skilled in the art might envisage that fall within the scope of the following claims.

Accordingly, the number of radiating elements in each subarray may be any number at least equal to two.

The number of subarrays of an antenna may be any number at least equal to two.

Embodiments of subarrays have been described in which the radiating elements consisted of a multilayer structure comprising radiating patches. The invention is not limited to this type of radiating element alone, however. It relates equally to subarrays equipped with radiating elements such as microstrip resonators, slots, or dielectric resonators.

There is claimed:

1. A reflector array antenna divided into independent subarrays each comprising:

at least two radiating elements adapted firstly to collect signals delivered by a source and having at least one chosen first polarization and secondly to send phase-shifted signals having at least one chosen second polarization orthogonal to the first polarization, combination means adapted to sum said collected signals as a function of a chosen first phase law so that they correspond to a chosen source pointing direction, phase control means adapted to apply a chosen phase shift to the summed signals, and distribution means adapted to distribute said phase-shifted signals between said radiating elements as a function of a chosen second phase law so that said radiating elements of each subarray radiate them in a pointing direction of a chosen area with the second polarization, in which antenna said combination means and said distribution means are separate so that said subarrays are of a nonreciprocal type.

2. The antenna claimed in claim 1, wherein said phase control means and said distribution means of the antenna are configurable so that said pointing direction of the chosen area is variable.

3. The antenna claimed in claim 1, wherein said phase control means are phase shifters.

4. The antenna claimed in claim 3, wherein said phase shifters comprise at least two delay lines with different configurations and at least one microelectromechanical system.

5. The antenna claimed in claim 1, wherein said combination means comprise a transmission line having branches coupled to said radiating elements to collect in parallel the signals having said first polarization and conformed to define said first phase law.

6. The antenna claimed in claim 1, wherein said combination means comprise a transmission line comprising line portions connecting said radiating elements to each other to collect in series the signals having said first polarization and conformed to define said first phase law.

7. The antenna claimed in claim 1, wherein said distribution means comprise a transmission line having branches coupled to said radiating elements to distribute in parallel the phase-shifted signals and conformed to define said second phase law.

8. The antenna claimed in claim 1, wherein said distribution means comprise a transmission line consisting of line portions connecting said radiating elements to each other to distribute in series the phase-shifted signals and conformed to define said second phase law.

9. The antenna claimed in claim 1, wherein each subarray is planar.

10. The antenna claimed in claim 1, wherein each subarray is linear, its radiating elements being aligned in a chosen direction.

11. The antenna claimed in claim 9, wherein said subarrays are installed in parallel to constitute a strip of at least two subarrays.

12. The antenna claimed in claim 11, comprising at least two parallel strips.

13. The antenna claimed in claim 1, wherein said radiating elements are adapted to collect signals having said chosen first and second polarizations and comprising first polarization selection means interleaved between said radiating elements and said combination means and second polarization selection means interleaved between said distribution means and second said radiating elements, said first and second polarization selection means being adapted to select one of said first and second polarizations on command so that said antenna is able to operate in two different polarization modes.

14. The antenna claimed in claim 1, wherein said radiating elements are adapted to collect signals having said chosen first and second polarizations and comprise polarization selection means adapted to select one of said first and second polarizations on command so that said antenna is able to operate in two different polarization modes.

15. The antenna claimed in claim 5, wherein each transmission line is implemented in a technology chosen from a group comprising a microstrip technology, a coplanar technology and a triplate technology.

16. The antenna claimed in claim 1, wherein said radiating elements are chosen from a group comprising multilayer structures with radiating patches, microstrip resonators, slots and dielectric resonators.

17. The antenna claimed in claim 1, wherein said radiating elements are coupled to said combination means and to said distribution means by direct contact.

18. The antenna claimed in claim 1, wherein said radiating elements are coupled electromagnetically to said combination means and to said distribution means.

19. The antenna claimed in claim 1, wherein each subarray comprises amplifier means adapted to amplify said summed waves before they are sent and/or once they have been collected.

* * * * *